US012753533B2

(12) United States Patent
Borsoi et al.

(10) Patent No.: US 12,753,533 B2
(45) Date of Patent: Oct. 6, 2026

(54) MACHINE FOR THE SEPARATION OF A PADDING FROM A LINING OF PADDED TEXTILE ARTICLES

(71) Applicant: BORSOI S.R.L., Vittorio Veneto (IT)

(72) Inventors: Alessandro Borsoi, Vittorio Veneto (IT); Michele Borsoi, Vittorio Veneto (IT)

(73) Assignee: BORSOI S.R.L., Vittorio Veneto (IT)

( * ) Notice: Subject to any disclaimer, the term of this patent is extended or adjusted under 35 U.S.C. 154(b) by 0 days.

(21) Appl. No.: 19/105,833

(22) PCT Filed: Sep. 7, 2023

(86) PCT No.: PCT/IB2023/058852
§ 371 (c)(1),
(2) Date: Feb. 24, 2025

(87) PCT Pub. No.: WO2024/052848
PCT Pub. Date: Mar. 14, 2024

(65) Prior Publication Data

US 2026/0055539 A1 Feb. 26, 2026

(30) Foreign Application Priority Data

Sep. 8, 2022 (IT) ..... 102022000018324

(51) Int. Cl.
*D01G 11/00* (2006.01)

(52) U.S. Cl.
CPC ..... *D01G 11/00* (2013.01)

(58) Field of Classification Search
CPC ..... D01G 11/00; D01G 11/04; Y02W 30/66; B02C 13/02; B02C 13/04; B02C 13/13
See application file for complete search history.

(56) References Cited

U.S. PATENT DOCUMENTS 2,697,256 A * 12/1954 Schaefer ..... D01G 11/02 19/81
3,750,235 A * 8/1973 Wise ..... D01G 9/16 19/145.5

(Continued)

FOREIGN PATENT DOCUMENTS

CN 206868361 U 1/2018
CN 109234855 A 1/2019

(Continued)

OTHER PUBLICATIONS

International Search Report From PCT/IB2023/058852.

*Primary Examiner* — Aiying Zhao
(74) *Attorney, Agent, or Firm* — Carmel Patent Agency; Robert Ballarini

(57) ABSTRACT

A machine for separating a padding from a lining of padded textile articles includes a support structure internally defining at least one operating channel that extends between: an inlet section in which a plurality of fragments of padded textile articles are introduced into the operating channel; a first outlet section in which a plurality of lining fragments are expelled from the operating channel; and a second outlet section in which a mass of padding separated from the lining fragments is expelled from the operating channel. The machine also includes shaking means operationally housed in the operating channel that intercepts the plurality of fragments of padded textile articles, urging them inside the operating channel to thus mechanically separate the mass of padding from the plurality of lining fragments.

13 Claims, 9 Drawing Sheets

(56) References Cited

U.S. PATENT DOCUMENTS

| | | | | | |
|---|---|---|---|---|---|
| 4,241,474 | A | | 12/1980 | Doutre | |
| 5,705,030 | A | * | 1/1998 | Gassner, III | D06L 4/10 162/1 |
| 2017/0368553 | A1 | * | 12/2017 | Nunn | D01G 11/00 |

FOREIGN PATENT DOCUMENTS

| | | | | | |
|---|---|---|---|---|---|
| CN | 109295559 | A | * | 2/2019 | D01G 15/26 |
| DE | 69622864 | T2 | | 3/2003 | |
| EP | 1023951 | A2 | * | 8/2000 | D01G 11/00 |
| EP | 1023951 | A3 | | 8/2000 | |
| GB | 1394950 | A | | 5/1975 | |
| WO | 2022097016 | A1 | | 5/2022 | |

* cited by examiner

MACHINE FOR THE SEPARATION OF A PADDING FROM A LINING OF PADDED TEXTILE ARTICLES

CROSS-REFERENCE TO RELATED APPLICATIONS

This application is a § 371 National Phase of PCT/IB2023/058852, filed Sep. 7, 2023, which claims priority of Italian Patent Application No. 102022000018324, filed Sep. 8, 2022, the entire contents of all of which are incorporated by reference as if fully set forth.

TECHNICAL FIELD

The present invention concerns a machine for separating a padding from a lining of padded textile articles.

The present invention therefore finds an advantageous use in the technical sector of the production and marketing of machines and equipment for the recycling of textile articles, in particular for the separation of a padding from a lining of disused textile articles.

In particular, the present invention can find an advantageous use for separating a down padding from a textile lining, in particular of padded clothing, such as for example down jackets or the like.

Obviously, the present invention can be used to separate any type of padding from any type of lining without thereby departing from the scope of protection of this patent.

In particular, the linings can for example be made of fabric or other material, for example natural or synthetic fibers and the padding can be made of natural feathers (for example goose feathers or down) or synthetic material.

BACKGROUND

The need to separate the padding from the lining of disused textile articles, for example from padded items of clothing, is known in the relevant technical sector, in order on the one hand to appropriately differentiate the materials for their disposal and on the other end to be able recycle the most expensive materials, especially goose down or feathers.

Normally, this activity of separating the padding from the lining is performed manually, i.e. by specialized operators who cut and/or unstitch the lining to free and separate the padding contained therein.

In some specialized industrial companies, it is known to carry out this separation activity manually after shredding the padded articles using an automatic shredder.

However, this separation activity has proven to be not without drawbacks in practice.

The main drawback lies in the fact that—in addition to requiring manual extraction of the padding, with the resulting costs and time required—automatic shredding generates a large quantity of lining fragments, which are difficult to trace and remove manually which, therefore, they mix with the padding.

In the particular case in which the padding is made of natural feather or down, if the latter is contaminated by a large quantity of fragments of fabric from the lining, it is no longer possible to recycle it.

In fact, the regulations currently in force on the subject require that natural feathers and down have a concentration of impurities lower than a well-defined quantity, which cannot be respected with the aforementioned automatic shredding of the known type.

In this situation, it is clear that completely manual separation has the intrinsic drawback of requiring a plurality of specialized operators who remain busy full time to unstitch the lining and carefully remove the padding, with a large cost in terms of labor and time necessary to carry out the operation satisfactorily, i.e. in such a way that the padding has a low concentration of impurities to be able to be reused and/or recycled.

Similarly, separation with automatic shredding has the intrinsic drawback of polluting the padding with a quantity of lining fragments not permitted by regulations in order to be able to reuse and/or recycle the padding itself.

Furthermore, this separation with automatic shredding in any case does not solve the drawback of necessarily having to employ specialized operators who remove the stuffing from the lining, with the consequent aforesaid labor and time costs for the execution.

EP1023951 describes a solution in which, inside a diffuser duct, a comb acts to retain the filling material. In particular, the comb is mounted on an arm which performs an alternating movement in a direction perpendicular to the development direction of the diffuser duct.

OBJECT OF THE INVENTION

The object of the invention is to propose a machine for separating a padding from a lining which overcomes, at least in part, the drawbacks of the prior art mentioned above.

A further object of the present invention is to propose a machine which is substantially automatic and which allows the use of a reduced number of operators.

A further object of the present invention is to propose a machine which is completely reliable from a constructional and operational point of view.

A further object of the present invention is to propose a machine which requires little maintenance.

A further object of the present invention is to propose a machine which allows to obtain a high efficiency in the separation of the stuffing.

Another object of the invention is to propose a machine which allows to obtain substantially clean padding separated from the lining, ie with a low concentration of lining or other particles.

Another object of the invention is to propose a machine which has high productivity and which allows a greater quantity of padding to be separated from the lining in a given unit of time.

Another object of the invention is to propose a machine that can be used with padded textile articles of any nature, size, material and/or fabric, for example blankets, jackets, cushions, sleeping bags, etc.

Another object of the invention is to propose a machine that has an alternative characterization, both in constructive and functional terms, compared to traditional ones.

Another object of the invention is to propose a machine that can be used and installed in line in systems for the recovery of padded articles or clothing or similar.

Another object of the invention is to propose a machine that allows to obtain recycled padding with a high-quality standard.

Another object of the invention is to propose a machine that can be manufactured simply, quickly and/or at low costs.

SUMMARY

These objects, both individually and in any combination thereof, as well as other objects which will result from the following description, are achieved, according to the invention, with a machine as defined below.

BRIEF DESCRIPTION OF THE DRAWINGS

The present invention is further clarified below in a preferred form of practical embodiment reported for merely illustrative and non-limiting objects with reference to the attached drawings, in which.

DETAILED DESCRIPTION OF THE PREFERRED EMBODIMENTS

Figure 1:
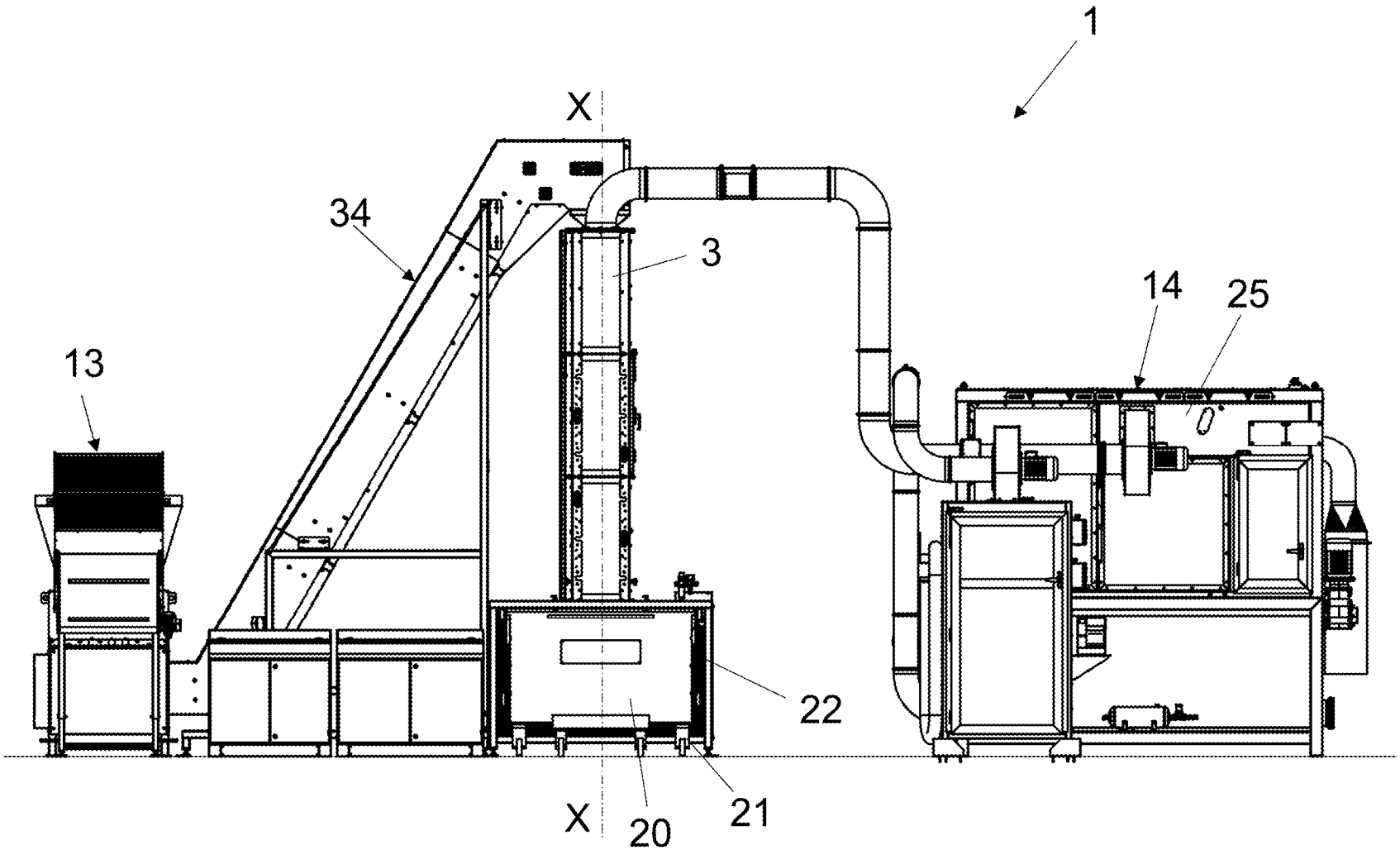
FIG. 1 shows a side view of the machine for separating a padding from a lining according to the invention.
Figure 2:
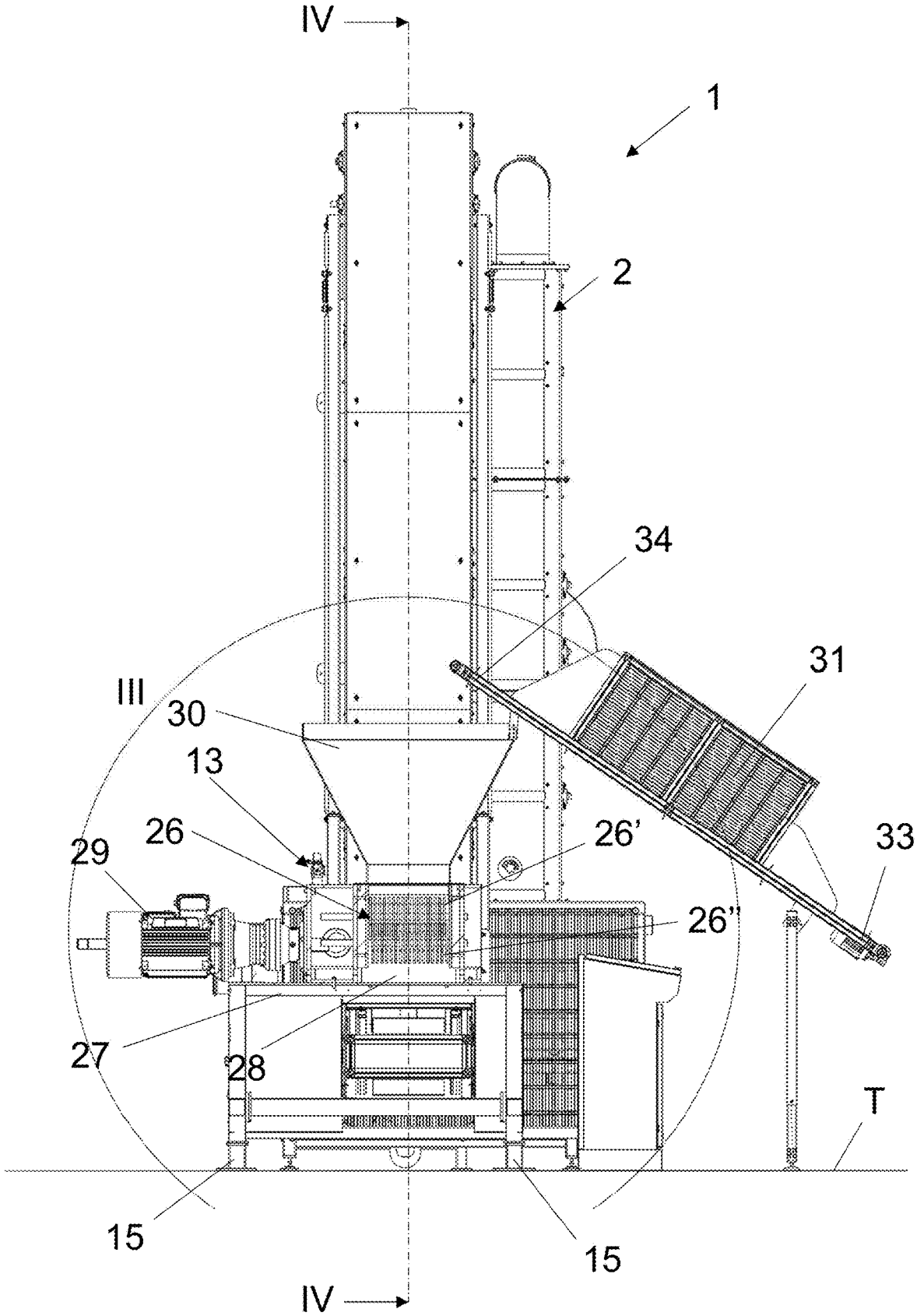
FIG. 2 shows a front view of the machine in FIG. 1.
Figure 3:
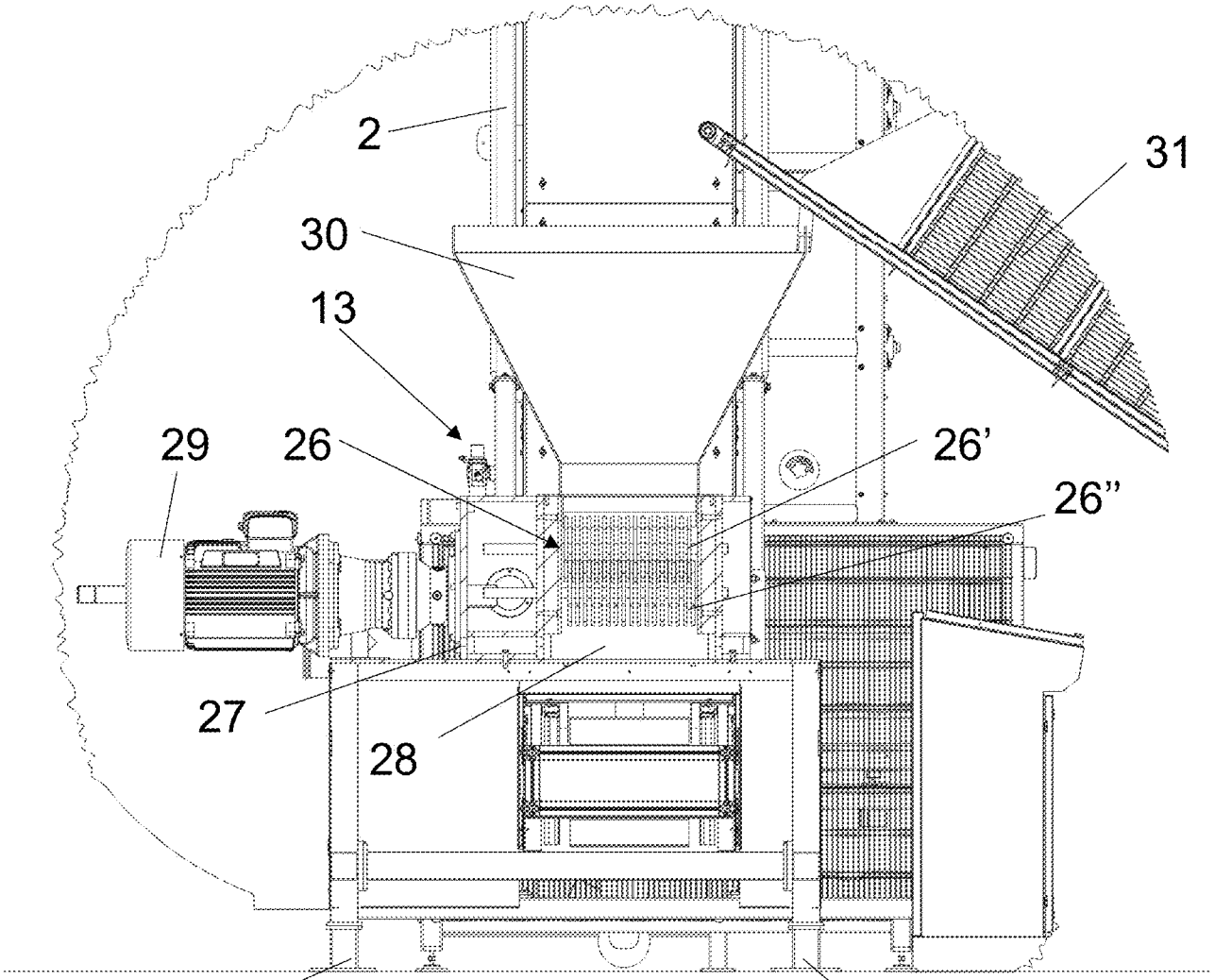
FIG. 3 shows a front view of a detail of the machine according to the invention, concerning a shredding station, made according to the line III of FIG. 2.
Figure 4:
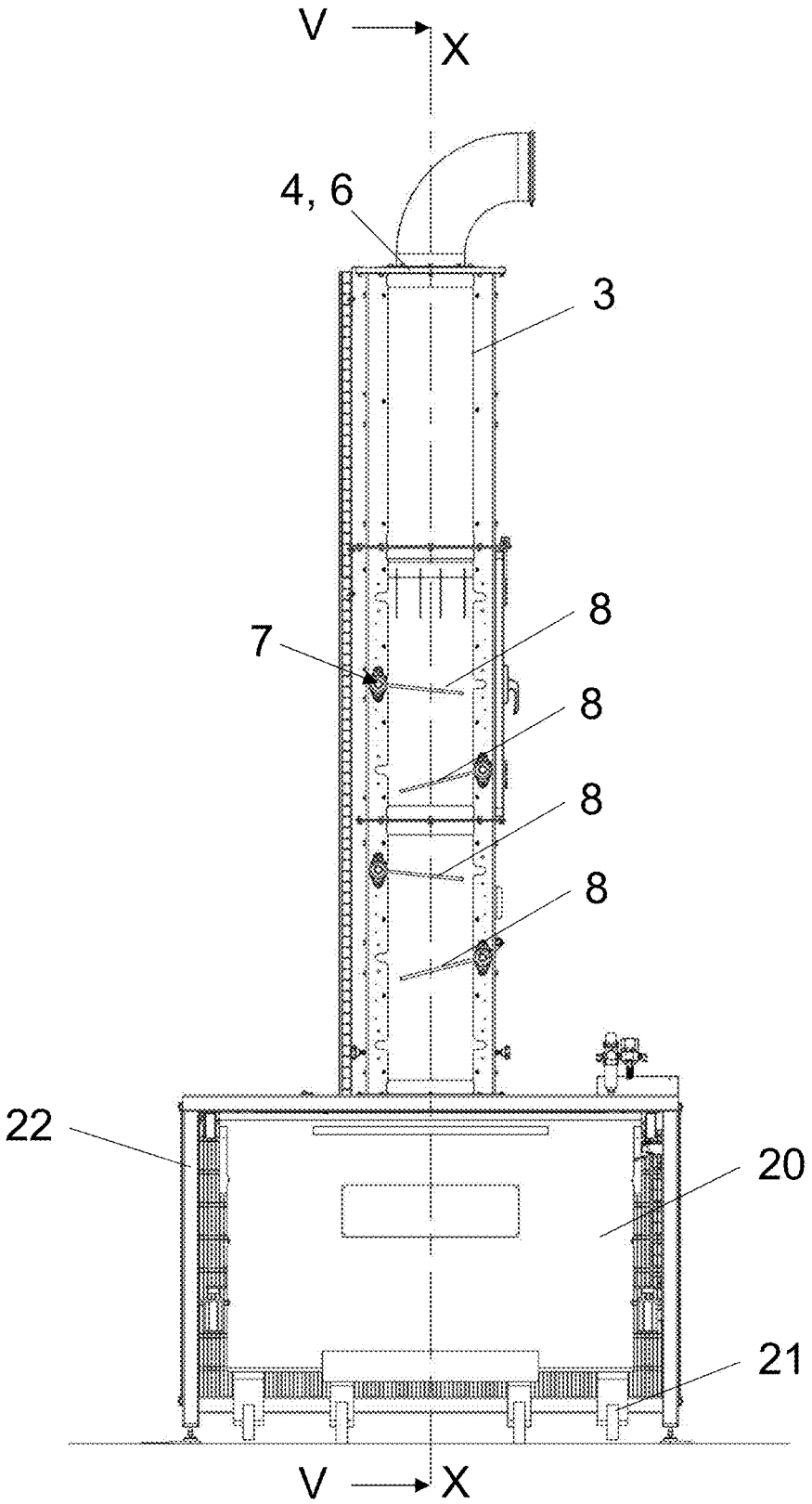
FIG. 4 shows a section of the machine according to the invention, created according to line IV-IV of FIG. 2.
Figure 5:
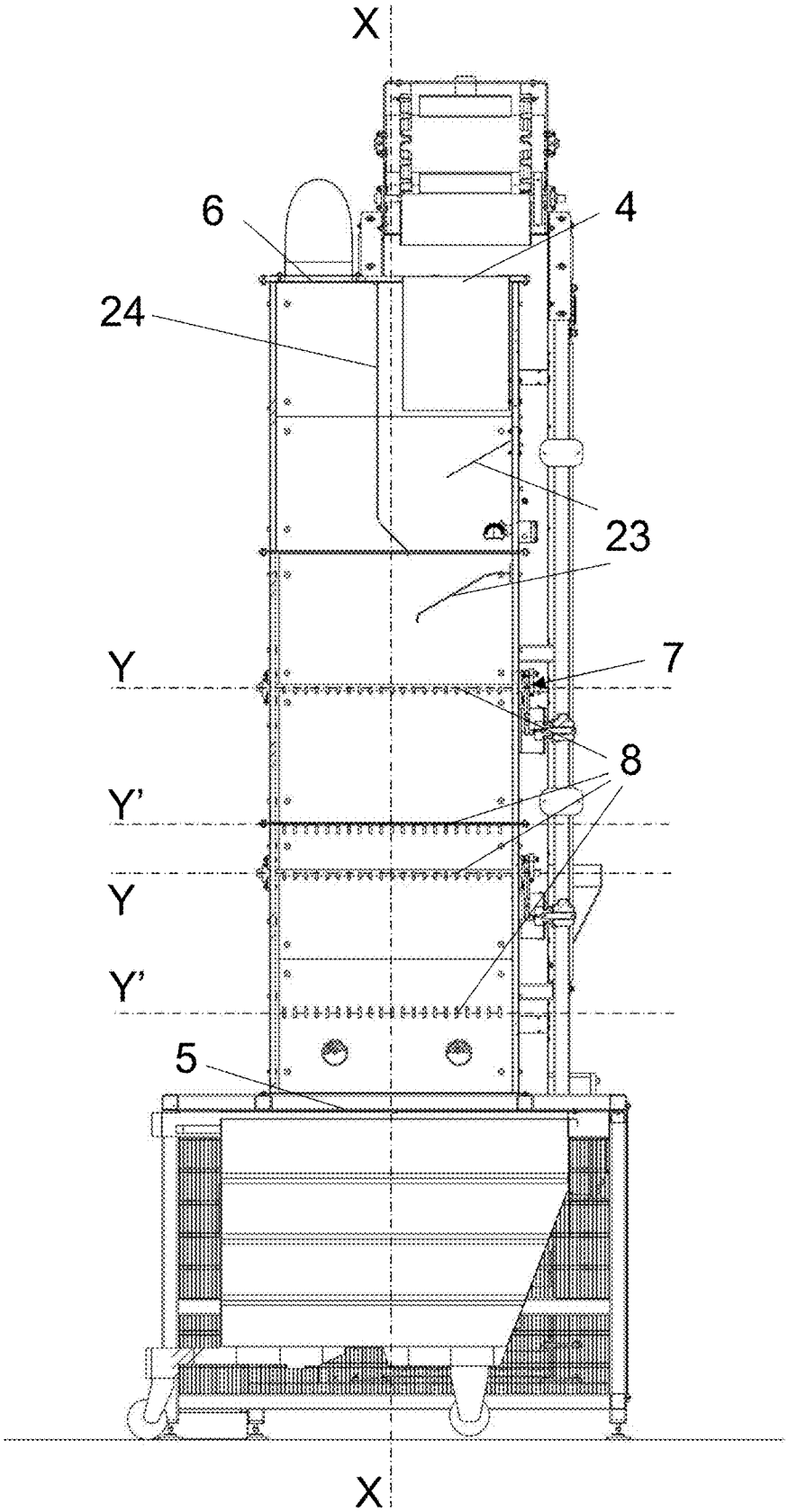
FIG. 5 shows a section of the machine according to the invention, created according to the trace VV of FIG. 4.
Figure 6:
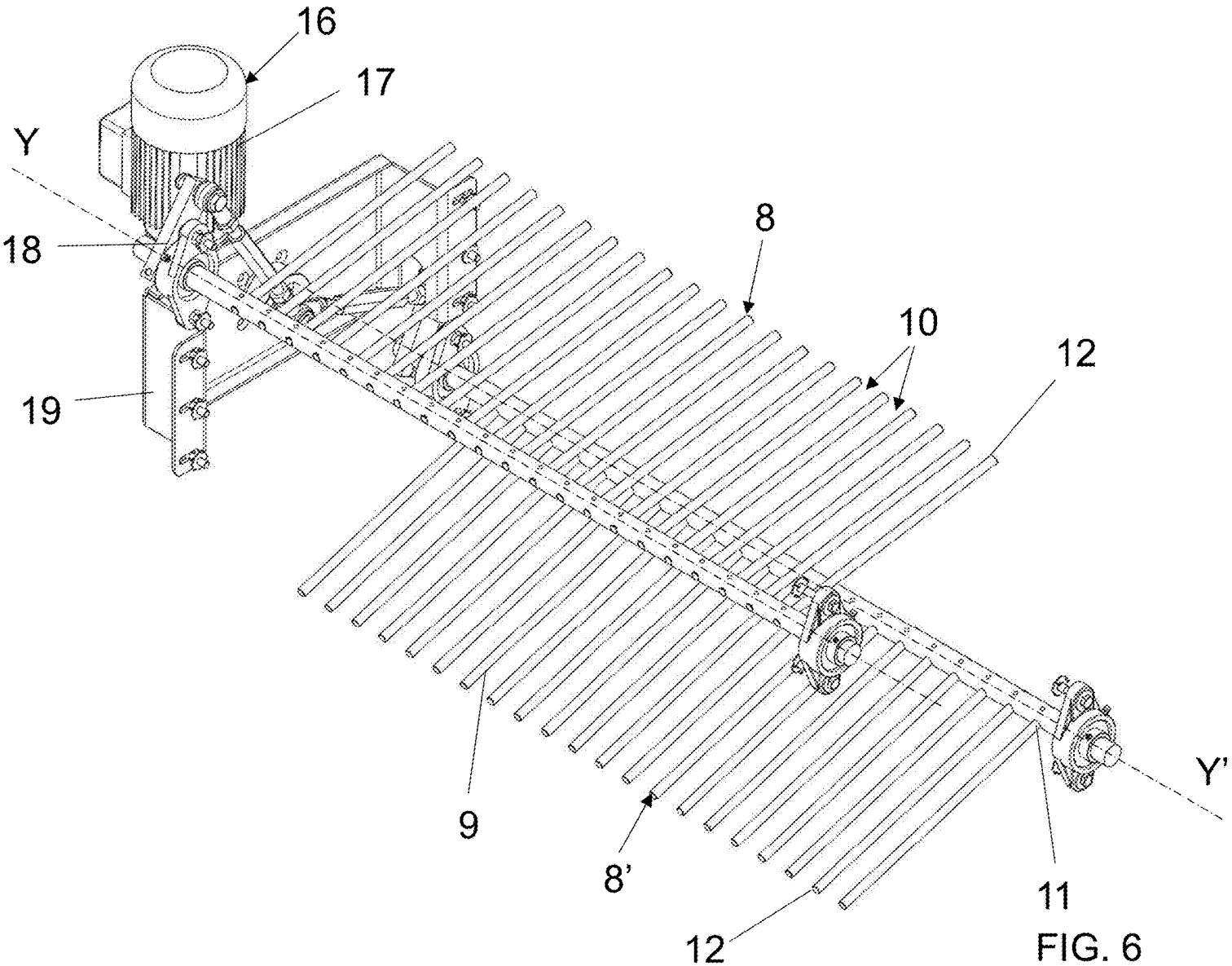
FIG. 6 shows a perspective view from above of the shaking means of the machine according to the invention.
Figure 7:
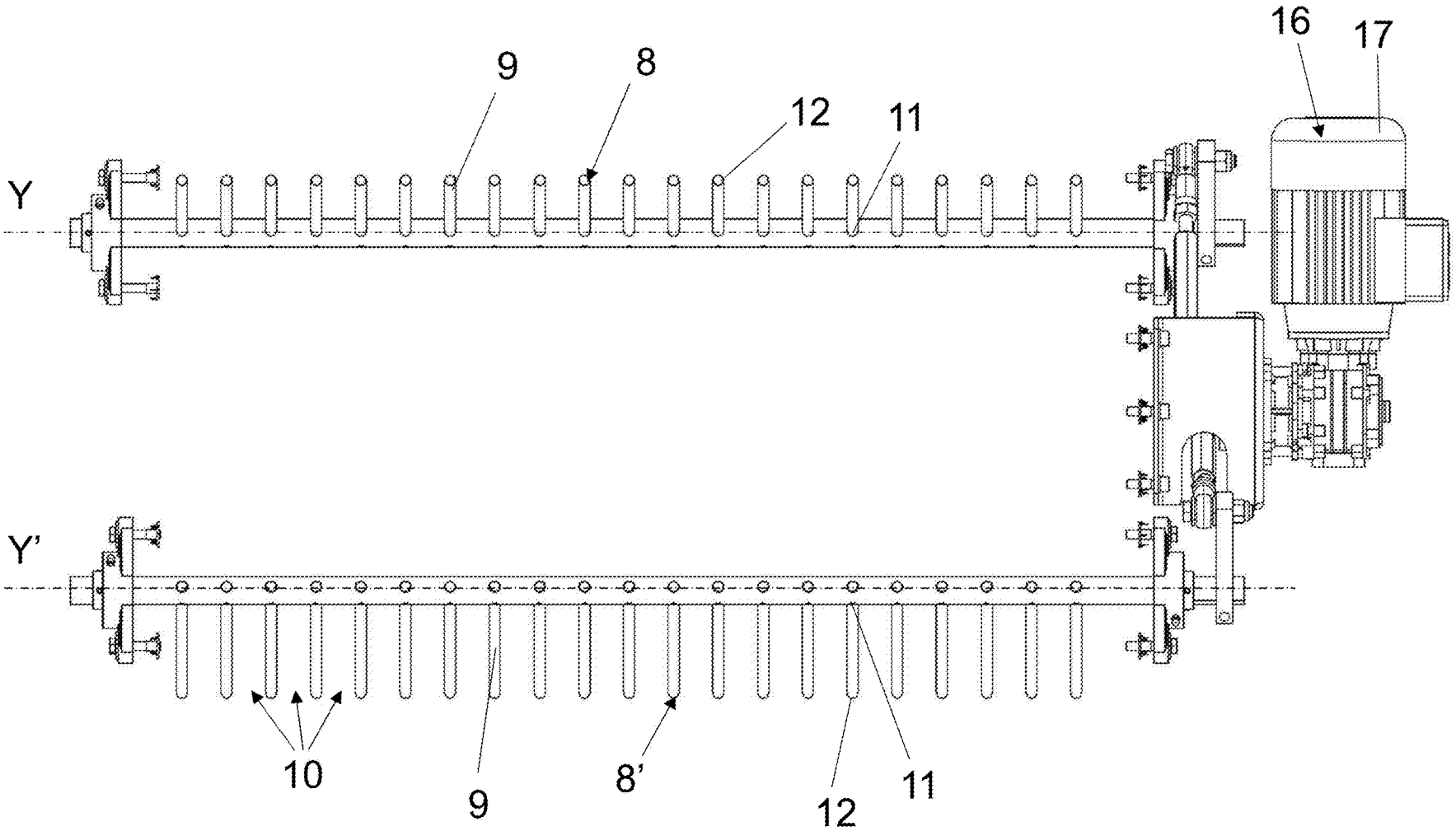
FIG. 7 shows a side view of the shaking means of FIG. 6.
Figure 8:
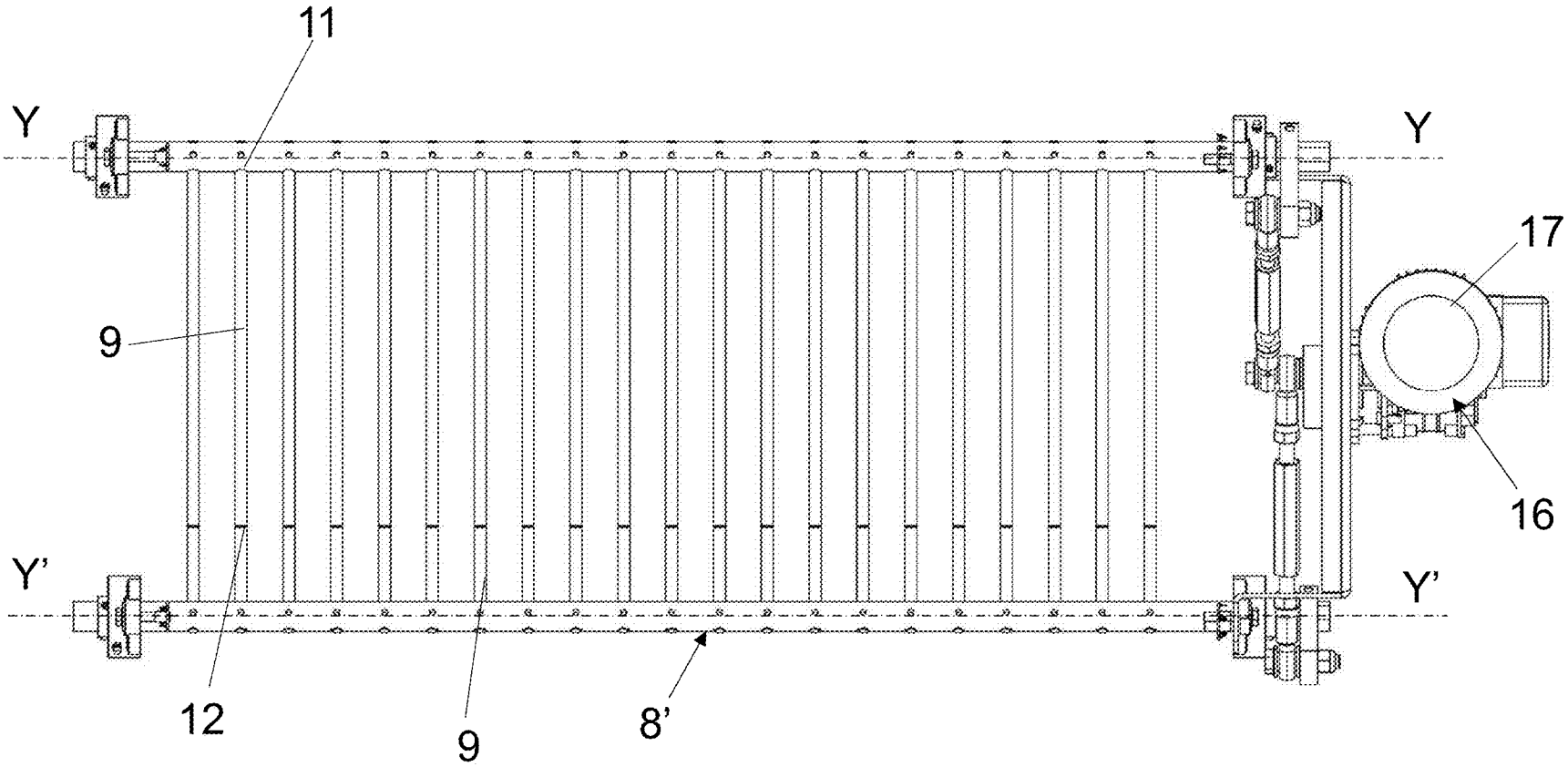
FIG. 8 shows a top plan view of the shaking means of FIGS. 6 and 7.
Figure 9:
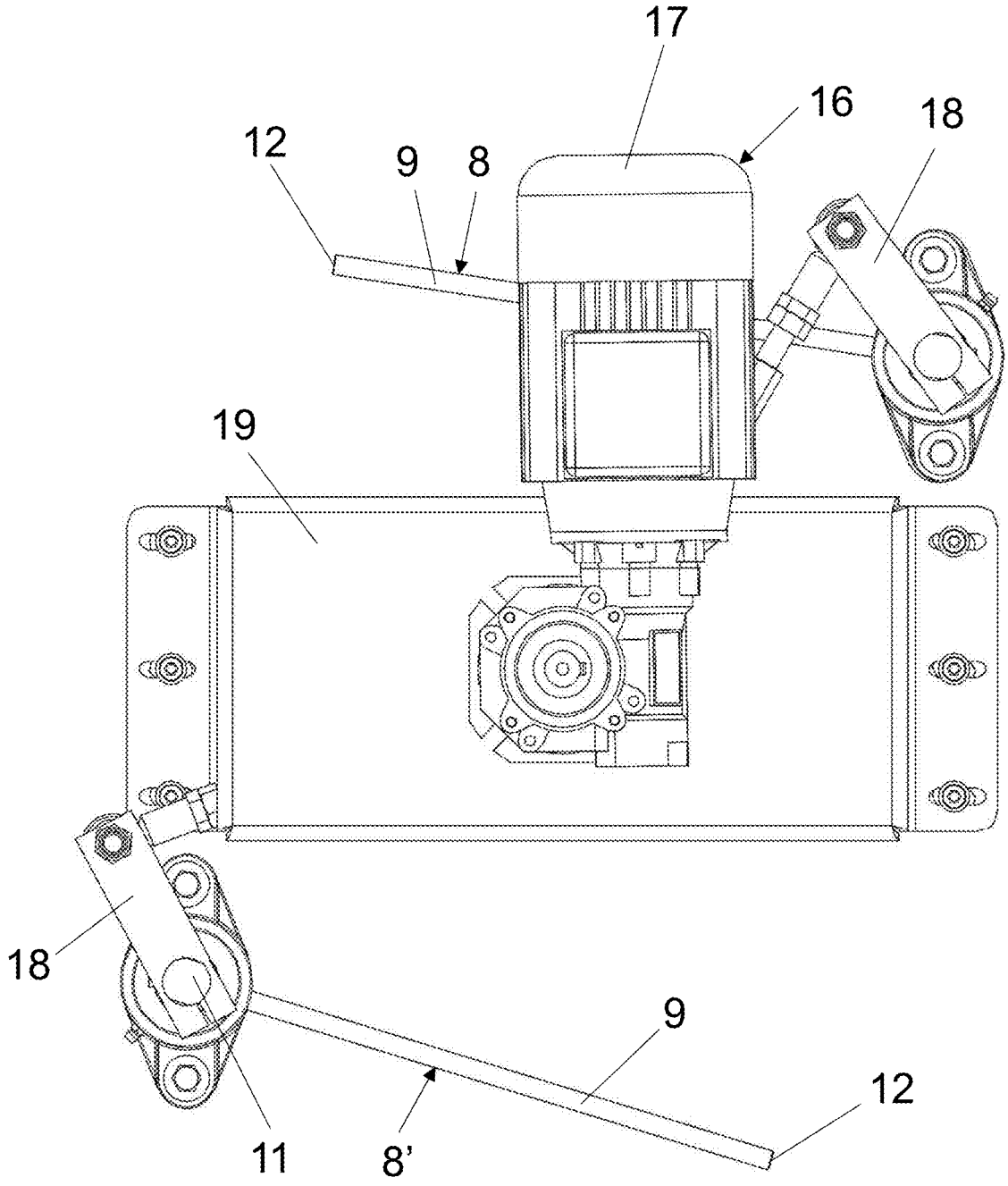
FIG. 9 shows a front view of the shaking means of FIGS. 6-8.

As can be seen from the figures, the machine for separating a padding from a lining of padded textile articles according to the invention—indicated overall with the reference number 1—is configured to separate the padding from the lining of textile articles, for example clothing or blankets, in particular in a substantially automatic manner.

The separation machine in question therefore finds advantageous use in the technical sector of recovery and/or reuse and/or recycling of padded textile articles, for example clothing padded with feathers or down, particularly of natural origin.

Normally, padded textile articles have an external lining, normally made of fabric or similar, which defines inside a volume filled with padding, with the object of increasing the ability to retain the user's body heat.

The machine in question conveniently allows the aforementioned padding to be removed from the lining in a substantially automatic manner, as will become clear in the following description.

The machine for separating padding from a lining of padded textile articles comprises a support structure 2 internally defining at least one operating channel 3.

Preferably, the operating channel 3 has a longitudinal development which is substantially aligned vertically.

The support structure 2 is preferably made of rigid and mechanically stable material, for example metal, in particular steel or the like.

The support structure 2 is suitably intended to be rested on the ground T, by means of a base 15, for example comprising support feet for being stably rested on the ground.

The operating channel 3 defined inside the support structure 2 extends between an input section 4 in which a plurality of fragments of padded textile articles are introduced into said operating channel 3, and at least a first output section 5 in which a plurality of lining fragments is expelled from said operating channel 3, and a second outlet section 6 in which a mass of padding separated from said lining fragments is expelled from said operating channel 3.

In particular, operating channel 3 includes:

- an inlet section 4 for the entry into the operating channel of a plurality of fragments of padded textile articles,
- a first outlet section 5 for the exit from the operating channel of a plurality of lining fragments,
- a second outlet section 6 for the outlet from the operating channel of a mass of padding separated from said lining fragments.

Preferably, the inlet section 4 is positioned higher than the first outlet section 5 and, in particular, is located at a height/altitude from the ground where the machine is supported which is greater than the first outlet section 5.

Preferably, the inlet section 4 is positioned at an upper end of said operating channel 3, so as to have a fall by gravity of said plurality of fragments of padded textile articles inside the operating channel 3.

Preferably, the second outlet section 6 is positioned higher than the first outlet section 5 and, in particular, is located at a height/altitude from the ground where the machine is supported which is greater than the first outlet section 5. The machine 1 includes shaking means 7 operationally housed in said operating channel 3 and configured to intercept said plurality of fragments of padded textile articles and to mechanically separate said padding mass from said plurality of lining fragments.

Conveniently, the shaking means 7 comprise at least one comb 8 which is configured so as to oscillate along the direction of development X of said operating channel 3.

Conveniently, the shaking means 7 comprise at least one comb 8 oscillating alternatively along a vertical direction and/or along the direction of advancement or fall of said plurality of fragments of padded textile articles inside the operating channel 3. In particular, said at least one comb 8 comprises a plurality of elongated elements 9 placed side by side, each elongated element having one end fixed to a common section and a free end, and in which the free ends of the elongated elements 9 of each comb 8 are movable along the direction of development.

In this way, the machine 1 allows the padding to be separated from the lining in a substantially automatic, rapid manner and without requiring the use of specialized operators.

Advantageously, the shaking means 7 comprise at least one comb 8 movable alternately between a first configuration, moving away from said inlet section 4 and a second configuration, approaching said inlet section, to thus at least partially repel said plurality of fragments of padded textile articles towards said inlet section.

Preferably, the shaking means 7 are configured to intercept the plurality of fragments of textile articles, moved from the input section 4 towards the first output section 5, and thus reject them, by moving from the first configuration to the second configuration, towards the section input 4.

Preferably, in accordance with the preferential but non-limiting embodiment illustrated in the attached figures, said at least one comb 8 of the shaking means 7 comprises a plurality of elongated elements 9, arranged spaced apart and parallel and movable together between the first and second configuration.

More preferably, said at least one comb 8 of said shaking means comprises elongated elements 9 developing parallel to each other, configured to intercept said plurality of fragments of padded textile articles and delimiting passage slots 10 between them to allow the passage of at least said fragments of lining.

Conveniently, said shaking means 7 are configured to make said plurality of fragments of padded textile articles jump onto said elongated elements 9 until said mass of padding is separated from said fragments of lining.

Advantageously, said operating channel 3 extends longitudinally along a development direction X.

Preferably the direction X is substantially rectilinear and even more preferably it is substantially vertical.

Conveniently, said operating channel 3 develops vertically along said development direction X.

Preferably, said operating channel 3 extends along a longitudinal development direction.

Preferably, for this object, the support structure 2 includes a separation tower, extended vertically, inside which the operating channel 3 remains defined. Advantageously, the operating channel 3 can extend for a few meters, for example for approximately 5 m.

Advantageously, in accordance with the preferential embodiment illustrated in the attached figures, the operating channel 3 has a constant cross-section along the development direction X and preferably has a substantially quadrangular, in particular substantially rectangular, section.

Advantageously, said first end, in which said inlet section 4 and said second outlet section 6 are obtained, is arranged at the top while said second end, in which said first outlet section 5 is obtained, is arranged at the bottom.

Preferably, said at least one comb 8 of said shaking means 7 extends between a first edge 11 rotatably constrained to said support structure 2 and a free edge 12 defined by the ends of said elongated elements.

Advantageously, said at least one comb 8 of the shaking means 7 extends transversely with respect to the direction of development X substantially for the entire transversal extension of the operating channel 3.

Advantageously, in accordance with the preferential but non-limiting embodiment illustrated in the attached figures, said at least one comb is mobile in rotation around a rotation axis Y, orthogonal to said direction of development X, oscillating between said first configuration and said second configuration.

Advantageously, said at least one comb 8 of the shaking means 7 can move between the first and second configuration by tilting with respect to a lateral wall of the operating channel 3. Preferably, the inclination of the at least one comb with respect to the lateral wall of the operating channel it is between 0 and 180° and more preferably between 60° and 120° and even more preferably between about 80° and 100°.

Advantageously, the shaking means 7 comprise at least one actuator device 16 operationally associated with said at least one comb 8 and configured to move said at least one comb 8 between said first configuration and said second configuration.

More in detail, the actuator device 16 includes at least one motor 17, preferably an electric motor, and at least one transmission mechanism 18 interposed between the motor 17 and said at least one comb 8.

Preferably, said at least one comb 8 of the shaking means 7 is moved between the first and second configuration with a rotation speed of the motor 17 between 10 and 3000 rpm and more preferably between 100 and 1400 rpm and again more preferably between about 250 and 300 rpm.

Advantageously, the transmission mechanism 18 can include at least one connecting rod-crank type coupling suitable for converting the rotary motion of the engine 17 into an oscillatory movement, to thus make the at least one comb 8 oscillate between the first and second configuration.

Advantageously, said shaking means 7 comprise at least a first comb 8 and at least a second comb 8', rotatable around two corresponding rotation axes Y, Y' parallel to each other and orthogonal to said development direction second configuration.

Advantageously, the shaking means 7 comprise two distinct pairs of first comb 8 and second comb 8' parallel to each other and spaced apart along the development direction.

Preferably, said shaking means 7 comprise at least a first comb 8 and at least a second comb 8' overlapping each other along the direction of development (X) of said operating channel 3. Preferably, said at least one first comb 8 and said at least one second comb 8' comprise respective elongated elements 9 and are mounted inside the operating channel so that the respective elongated elements develop in opposite directions. Preferably, said at least one first comb 8 and said at least one second comb 8' are actuated by the same actuator device 16.

Obviously, the shaking means 7 may include any number of combs 8, 8' without thereby departing from the scope of protection of the present patent.

Advantageously, the shaking means 7 further comprises at least one support bracket 19, which is mechanically mounted on said support structure 2 and which is configured to mechanically support the motor 17 and the transmission mechanism 18.

Preferably, the machine 1 includes suction means 14 placed in communication with said second outlet section 6 and configured to suck said padding mass from said operating channel 3 towards said second outlet section 6.

Advantageously, the suction means 14 comprise at least one fan (not shown in the attached figures) configured to generate a depression in correspondence with the second outlet section 6.

Operationally, the inlet section 4 is crossed by the plurality of fragments of padded textile articles, which intercept the shaking means 7, designed to intercept and make the fragments "jump" until the padding is separated from the lining fragments.

Preferably, the shaking means 11 are configured to make said plurality of fragments of padded textile articles jump onto said elongated elements 9 until said mass of padding is separated from said fragments of lining.

The suction means 14 suck the padding mass through the second outlet section 6, letting the lining fragments fall through the combs 8 of the shaking means 7.

Advantageously, the suction means 14 are configured to generate a suction air flow rate between 200 and 6000 $m^3/h$ and preferably between 500 and 3500 $m^3/h$ and more preferably between 1500 and 2000 rpm.

Advantageously, the suction means 14 are configured to generate a total suction pressure between 10 and 500 $mmH_2O$ and preferably between 50 and 300 $mmH_2O$ and more preferably between 100 and 125 $mmH_2O$.

In this way, the machine 1 according to the present invention allows the padding to be separated from the lining in an automated and precise manner.

Furthermore, the machine according to the invention allows to obtain a high-quality padding, substantially free of unwanted particles, for example free of lining fragments.

Preferably the input section 4 and the second output section 6 can be placed side by side at the first upper end of the operating channel 3.

Preferably, the machine 1 can further comprise at least one separator element 24 placed between the input section 4 and the second output section 6.

More in detail, the separator element 24 develops at least partially parallel to the direction of development X starting from the first upper end of the operating channel 3 and is configured to prevent the plurality of fragments of padded textile articles, entering the operating channel 3 from inlet section, to be immediately sucked by the suction means 14 towards the second outlet section 6.

Conveniently, the machine can include deviation means arranged inside the operating channel 3, preferably in proximity to said inlet section 4, suitable for deviating said plurality of fragments of padded textile articles from the inlet section 4 towards the center of the operating channel 3.

More in detail, the deviation means can include at least one inclined wall 23 extending from a side wall of the operating channel 3 inclined with respect to the direction of development X towards the first outlet section 5.

Preferably, the deviation means comprise two or more inclined walls 23, substantially parallel to each other.

Advantageously, moreover, at least one collection chamber 25 can be provided which is in fluid communication with the fan and with the second outlet section 6 of the operating channel 3 and which is configured to contain the padding separated from the lining.

Advantageously, at least one rotatable member (not shown in the accompanying figures) can be rotatably housed inside the collection chamber 25; said revolving member is able to rotate around its rotation axis (preferably horizontal) to mix the padding collected there, for example to prevent it from becoming compressed.

Advantageously, the machine 1 can include at least one container 20, arranged in correspondence with the first outlet section 5 and configured to receive the lining fragments.

Preferably, the container 20 can be removed to empty the lining fragments. For this object, the container 20 can be provided with a trolley 21 to be able to be easily extracted.

For this object, the support structure 2 can define, downstream of the first outlet section 5, a chamber 22 suitable for housing the container 20.

Otherwise, in accordance with a further embodiment not illustrated in the attached figures, the machine 1 can comprise two or more operating channels 3, preferably arranged parallel to each other.

For this object, the machine according to the invention can advantageously comprise a further transport belt, extending between an end located in correspondence with said first output section 5, to collect said plurality of lining fragments and an end provided in correspondence with a further second inlet section of a second operating channel, in order to separate the lining fragments from the padding mass again. In this way, the machine according to the invention can achieve a better separation quality.

Preferably, the machine 1 can include at least one shredding station 13 operatively connected with said inlet section 4 and configured to receive padded textile articles and shred them into said plurality of fragments of padded textile articles.

Preferably, in order to allow correct extraction of the padding from the lining, the shredding station 13 is configured to create fragments of padded textile articles with an elongated development along a prevailing direction.

More in detail, the shredding station includes cutting means 26 suitable for receiving padded textile articles and shredding them and/or cutting them into fragments, in particular having an elongated development, for example substantially in the shape of strips, strings or the like.

For this object, the cutting means 26 preferably comprise a first series of cutting blades 26' and a second series of counter cutting blades 26", coupled together.

More in detail, the shredding station 13 includes a housing casing 27, defining inside it a shredding chamber 28 in which the cutting means 26 are arranged.

Preferably, the first series of blades 26' and the second series of blades 26" are connected to corresponding first and second rotatable shafts, which rotatable shafts can be moved in rotation around respective rotation axes (preferably horizontal) parallel to each other.

Advantageously, each blade of the first series of blades 26' is spaced apart from the corresponding blade of the second series of blades 26" by a linear distance of approximately 1/10 of a mm.

In accordance with the preferential embodiment illustrated in the attached figures, the shredding station 13 includes four different series of blades 26 rotating around respective rotation axes that are parallel to each other.

Advantageously, the shredding station 13 includes motor means 29 connected to the rotatable shafts to rotate the series of blades 26', 26".

Advantageously, the shredding chamber 28 is open at the top to accommodate the padded textile articles. For this object, the shredding station 13 can include a hopper 30 arranged above the shredding chamber 28 and the cutting means 26 to accompany the entry of the padded textile articles towards the cutting means 26.

To allow a simple loading of the padded textile articles inside the shredding chamber 28, the shredding station 13 includes a first conveyor belt 31, which extends between a loading end 33 which is located at a lower height (relative to the ground), to thus allow the operators to lay/position the padded textile articles on the belt 31, to an upper discharge end 32 which is provided above the hopper 30, to thus overturn the padded textile articles inside the chamber shredding 28.

Conveniently, the shredding chamber 28 is also open at the bottom, in correspondence with a discharge mouth to allow the exit of the plurality of fragments of padded textile articles.

Advantageously, in order to allow the insertion of the plurality of fragments of padded textile articles coming out of the shredding station 13 into the operating channel 3 (of the separation tower) in a substantially automatic manner, the machine 1 also includes a second belt conveyor 34 which develops in an inclined direction starting from the outlet of the shredding chamber 28 of the shredding station 13 up to the inlet section 4 of the operating channel 3.

From what has been said it is clear that the machine for separating a padding from a lining of padded textile articles according to the invention is particularly advantageous as:

- it is operationally completely reliable and, in particular, allows the padding to be separated from the lining automatically;
- it requires little maintenance, thus allowing high efficiency in separating the padding from the lining;
- it can also be used with already existing and operational machines and/or systems;
- it is simple and easy to use, as well as reducing maintenance interventions;
- it can be used with padded textile articles of substantially any shape, size, material and/or fabric.
- it is provided with an alternative characterization, both in constructive and functional terms, compared to traditional ones;
- it requires a small number of specialized operators;

it allows you to obtain recycled padding of a high quality standard and in particular with a low content of polluting particles;

it can be achieved simply, quickly and at low costs.

Unlike EP1023951 in which the comb holds and blocks the filling material by oscillating in a direction perpendicular to the development of the duct, in the solution according to the present invention shaking means are provided configured to make the plurality of fragments of padded textile articles jump into the inside the operating channel and, in particular, said shaking means comprise at least one comb 8 which is configured so as to oscillate along the development direction X of said operating channel 3. Advantageously, unlike EP1023951, in the solution according to the present invention, the comb does not hold and block the filling material with its prongs, but rather shakes and blows up the fragments of the padded textile articles so as to mechanically and automatically separate said mass of padding from said plurality of lining fragments, so that the mass thus separated from the lining fragments promptly exits the operating channel through the first exit section.

The present invention has been illustrated and described in one of its preferred embodiments, but it is understood that executive variations may be made to it in practice, without however departing from the scope of protection of the present patent for industrial invention.

The invention claimed is:

1. Machine for separating a padding from a lining of padded textile articles, the machine comprising:

a support structure internally defining an operating channel, which extends longitudinally along a vertical direction, the operating channel extending between:

an inlet section configured to accept a plurality of fragments of padded textile articles into said operating channel and a first outlet section configured as a passage for a plurality of lining fragments to exit said operating channel and a second outlet section configured as a passage for a mass of padding separated from said lining fragments to exit said operating channel;

shaking means, housed in said operating channel, which are configured to intercept said plurality of fragments of padded textile articles and mechanically separate said mass of padding from said plurality of lining fragments, wherein:

said inlet section is positioned higher than said first outlet section so as to have a fall by gravity of said plurality of fragments of padded textile articles inside the operating channel, said second outlet section is positioned higher than said first outlet section, said shaking means comprise at least one comb which is configured so as to oscillate along said vertical direction of extension of said operating channel, and wherein said at least one comb is alternately movable between a first configuration, distal from said inlet section, and a second configuration, proximal to said inlet section, configured to repel said plurality of fragments of padded textile articles towards said inlet section.

2. The machine according to claim 1, wherein said at least one comb of said shaking means comprises elongated elements extending parallel to each other, configured to intercept said plurality of fragments of padded textile articles and delimiting passage slots between said elongated elements, sized to allow said lining fragments to pass.

3. The machine according to claim 2, wherein said at least one comb of said shaking means extends between a first edge rotatably constrained or integral with said support structure and a free edge which is defined by free ends of said elongated elements.

4. The machine according to claim 1, wherein said operating channel extends along said vertical direction between a first upper end in which said inlet section is obtained and a second opposite end in which said first outlet section is obtained.

5. The machine according to claim 1, wherein the shaking means comprise at least one actuator device, operationally associated with said at least one comb, which moves said at least one comb between said first configuration and said second configuration.

6. The machine according to claim 5, wherein said at least one actuator device includes at least one motor and at least one transmission mechanism interposed between the at least one motor and said at least one comb, and wherein said transmission mechanism comprises at least one connecting rod-crank type coupling that converts a rotary motion of the motor into an oscillatory movement, thereby causing the at least one comb to oscillate between the first and the second configurations.

7. The machine according to claim 1, further comprising suction means placed in communication with said second outlet section, said suction means configured to suck said mass of padding from said operating channel towards said second outlet section.

8. The machine according to claim 1, wherein said at least one comb comprises at least one first comb and at least one second comb, rotatable around two corresponding rotation axes parallel to each other and orthogonal to said vertical direction in said first and second configurations.

9. The machine according to claim 1, wherein said at least one comb comprises at least one first comb and at least one second said comb overlapping each other along an extension direction of said operating channel.

10. The machine according to claim 9, wherein said at least one first comb and said at least one second comb comprise respective elongated elements and are mounted inside the operating channel so that the elongated elements develop in opposite directions.

11. The machine according to claim 10, wherein said at least one first comb and said at least one second comb are configured to be actuated by the same actuator device.

12. The machine according to claim 1, further comprising at least one shredding station operationally connected with said inlet section, which is configured to receive padded textile articles, the at least one shredding station configured to shred said padded textile articles into said plurality of fragments of padded textile articles.

13. The machine according to claim 12, wherein said at least one shredding station configured to produce elongated fragments of padded textile articles.

* * * * *